US006017128A

United States Patent [19]

Goldston et al.

[11] Patent Number: 6,017,128

[45] **Date of Patent: *Jan. 25, 2000**

[54] FOOTWEAR WITH FLASHING LIGHTS

[75] Inventors: Mark R. Goldston; Jon L. Bemis, both of Santa Monica; Carmen C. Rapisarda, Monrovia, all of Calif.

[73] Assignee: L.A. Gear, Inc., Los Angeles, Calif.

[ * ] Notice: This patent is subject to a terminal disclaimer.

[21] Appl. No.: 08/165,128

[22] Filed: Dec. 9, 1993

Related U.S. Application Data

[63] Continuation-in-part of application No. 08/013,839, Feb. 5, 1993, Pat. No. 5,303,485.

[51] Int. Cl.[7] ..... F21L 15/08

[52] U.S. Cl. ..... 362/103; 362/800; 36/137

[58] Field of Search ..... 362/103, 190, 362/191, 200, 802, 800; 36/137

[56] References Cited

U.S. PATENT DOCUMENTS

| | | | |
|---|---|---|---|
| 5,303,131 | 4/1994 | Wu | 362/200 |
| 5,303,485 | 4/1994 | Goldston et al. | 36/137 |
| 5,546,681 | 8/1996 | Goldston et al. | 36/137 |

FOREIGN PATENT DOCUMENTS

| | | | |
|---|---|---|---|
| 2838770 | 3/1980 | Germany | 36/137 |
| 9311681 | 6/1993 | WIPO | 36/137 |

*Primary Examiner*—Y. Quach

*Attorney, Agent, or Firm*—Mayer, Brown & Platt

[57] ABSTRACT

Footwear for improving the visibility of the wearer uses a circuit including a mechanically operated pressure switching mechanism, disposed in the footwear, to turn a lighting system off and on. The switch is responsive to pressure from the foot of the wearer. When a wearer raises a foot from the ground, the lighting system is activated. When the foot is returned to the ground, the lighting system is deactivated. The system may be disabled by removing a source of power from the circuit, or through the provision of a mechanically operable deactivation mechanism.

14 Claims, 6 Drawing Sheets

FOOTWEAR WITH FLASHING LIGHTS

RELATED APPLICATIONS

This application is a continuation-in-part of allowed U.S. patent application Ser. No. 08/013,839, filed Feb. 5, 1993, now U.S. Pat No. 5,303,485 which application is incorporated herein by reference in its entirety.

FIELD OF THE INVENTION

This invention pertains to footwear in general, and in particular, to footwear with lights that flash to enhance the visibility of the wearer.

BACKGROUND OF THE INVENTION

Footwear having lighting devices incorporated therein are known. Lighting devices have been incorporated into a variety of footwear, including dress shoes, athletic shoes, boots, sandals, etc. Reasons for including lighting devices in footwear include permitting the wearer to see or be seen in reduced light situations, to provide special effects during entertainment events, or as an element of fashion on the part of the wearer.

There are several known implementations of footwear lighting devices. The most basic implementation involves the use of a light source, (e.g. an incandescent bulb, a neon tube, or a light emitting diode ("LED"), a portable power supply such as a battery and a manually operated on-off switch. These elements are connected as an electric circuit and are located in a convenient location in the footwear, such as within the sole and/or heel structure.

A more complex implementation of lighted footwear includes the provision of a switching circuit to switch the light on and off in association with the presence or the absence of the wearer's foot in the shoe or the contact of the wearer's foot with the ground. The above-incorporated patent application is an example of this second implementation.

A third implementation involves the use of a so-called "motion switch" that is utilized to detect movement of the wearer's foot. The detection of movement causes the light to illuminate. Such a "motion switch" usually involves the use of a "tilt switch," i.e., a mercury switch, to sense the angular position of the shoe with respect to the gravity gradient to activate the circuit at a particular attitude of the switch.

There are several shortcomings associated with footwear that incorporate lighting systems in accordance with the above-discussed implementations. Shoes that provide for continuous illumination of the lighting device tend to exhaust their batteries more quickly than those that are on only intermittently. Shoes that utilize lighting devices that illuminate only when the foot is in contact with the ground or at a certain angular position relative to the ground are not effective in providing for increased visibility of the wearer for several reasons.

Footwear is more likely to be obscured by material on the ground when the foot is at ground level. Thus, if a shoe is designed to illuminate when the wearer's foot contacts the ground, oftentimes the light will not be visible due to its being obscured by material at ground level. The higher the light is above the ground when it illuminates, the further away it can be seen. In addition, if footwear emits visible light only when the shoe contacts the ground, illumination typically occurs when the lighting device is in an essentially static condition, i.e., not moving. It is well known that moving lights are more readily visible to third parties.

There are two psychophysical phenomena that act to insure that moving lights will be more readily seen than static ones: First, in a static field, a moving object is more easily detected by the eye than a static one. Second, under appropriate lighting conditions, a moving point source of light is perceived, due to the phenomenon of "persistence," by the human eye (and some cameras) as a large, elongated streak of light "painted" on the retina of the eye by the point source, rather than as a small, moving point of light.

Further, footwear incorporating the above-discussed lighting implementations can be expensive to manufacture and produce due to the added cost of the lighting system incorporated therein. Such lighting systems can include expensive electrical components and complicated electronic lighting designs that require a large investment in components and testing.

Finally, such shoes are typically unsuitable for serious athletic activities. This is due to the reduced structural integrity of the shoe caused by the incorporation of the lighting device, as well as an unacceptable increase in the weight of the shoe.

Thus, there is a need for a shoe that incorporates an economical and reliable lighting system that illuminates when the wearer's foot is removed from the ground in order to adequately increase the visibility of the wearer. Such a lighting system would stop the illumination when the wearer's foot regains contact with the ground, to save battery life. Such a shoe needs to be capable of being manufactured in a cost-efficient and simplified manner, but must be suitable for use in conducting typical athletic activities by not sacrificing performance and weight factors to accommodate the lighting system.

SUMMARY OF THE INVENTION

The present invention overcomes the problems of the prior art described above and enhances the visibility of the wearer by the provision of a simple, economical and reliable design for footwear that includes a lighting system that is "OFF" when the wearer's foot is in contact with the ground, and not moving, thereby conserving battery life, and is "ON" when the wearer's foot is removed from the ground and usually moving, thereby enhancing the wearer's visibility for the reasons discussed above.

The present invention provides three economical and reliable embodiments that overcome the above-discussed shortcomings of the prior art. The first embodiment provides for a mechanically operated lighting system incorporated into a plug-in module that is slidably insertable into and removable from the sole of a shoe. The plug-in module incorporates a source of power, a light emitting device, and a switch. When the switch is operated, power is provided to the light emitting device, causing the plug-in module to emit visible light.

The second preferred embodiment provides for a drop-in module, similar to the plug-in module, having a plurality of light-emitting devices associated therewith. The drop-in module may be "dropped in" to the sole of a shoe from an upper surface thereof. Once installed, the drop-in module may be covered with insole and/or midsole material. As with the first embodiment, the drop-in module incorporates a switch that, when operated, causes the light emitting devices to emit visible light.

The third embodiment provides for a plug-in module operated in a manner similar to the first two embodiments. The third embodiment incorporates a disabling mechanism operable by the wearer for disabling the lighting system without removing the power source or system from the shoe.

Each of the above-discussed embodiments of the present invention is simple, reliable, and cost effective from a manufacturing standpoint. These devices eliminate the complicated lighting systems of the prior art and provide for simple, mechanical implementations that are suitable for mass production using standard, readily available materials that can be purchased economically in large quantities.

The above and other features and advantages of the present invention will become more readily apparent upon a reading of the detailed description of the present invention taken in conjunction with the drawings of which the following is a brief description. However, it should be clear that the present invention is in no way limited to the embodiments shown in the drawings. The present invention is solely limited by the claims that are appended to this specification.

DESCRIPTION OF THE PREFERRED EMBODIMENTS

Figure 1:
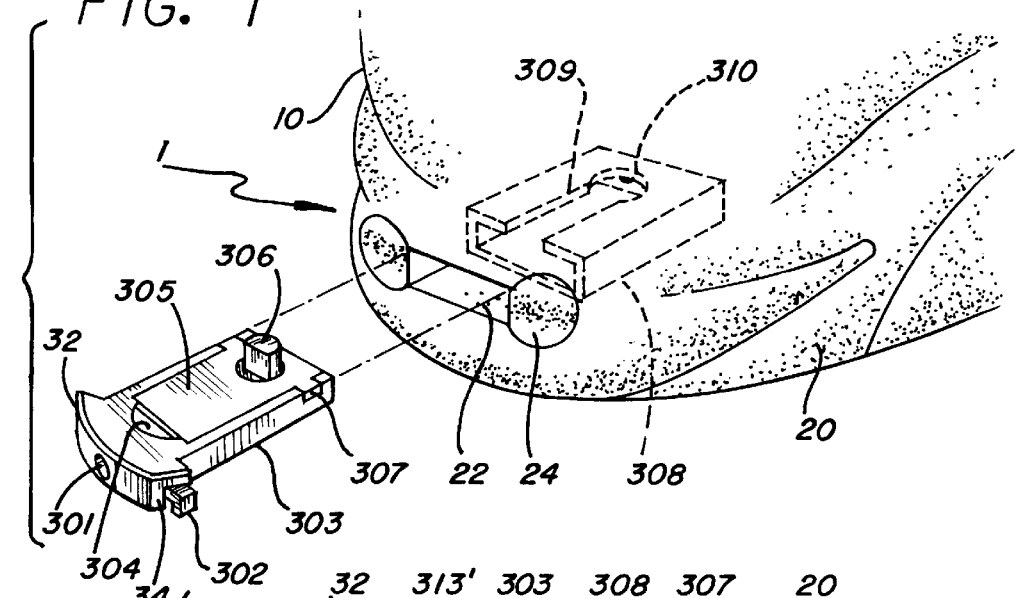
FIG. 1 is a rear perspective view of a shoe incorporating the novel lighting system of the present invention.
Figure 2:
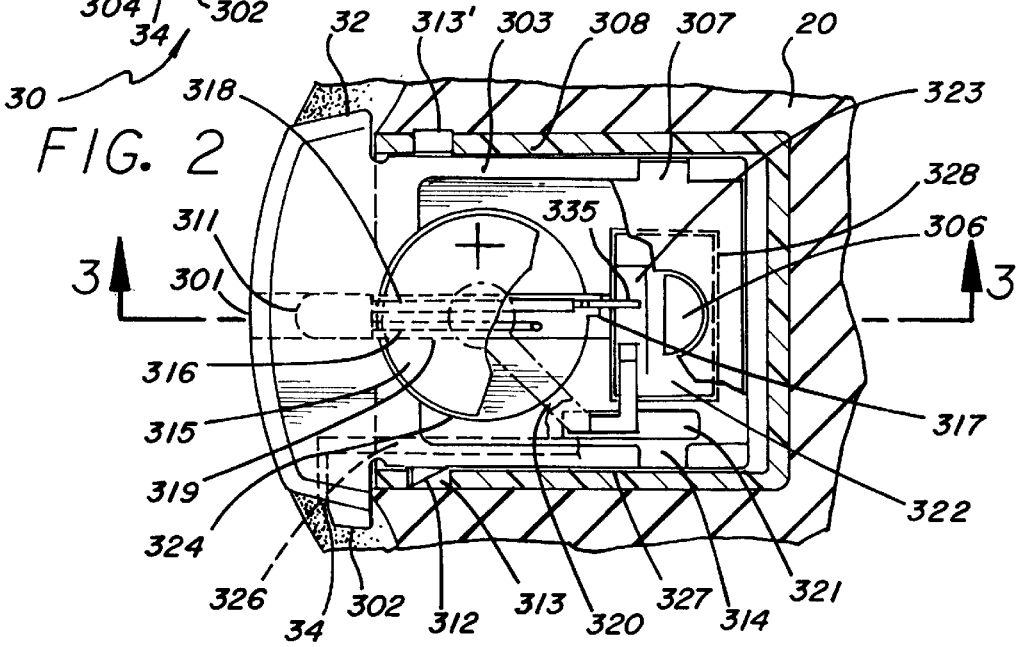
FIG. 2 is a cutaway top view of the lighting system of the present invention installed in the shoe shown in FIG. 1.

In the following description of the preferred embodiments of the present invention, like elements are referred to with like reference numerals. Further, while the following discussion utilizes an athletic shoe as an example of footwear within which the novel lighting system of the present invention is disposed, it should be well understood that the present invention is not limited to use with athletic shoes, but is suitable for use in all types of footwear.

Referring to FIGS. 1–5, a first preferred embodiment of the present invention is disclosed. An athletic shoe 1 typically includes an upper 10 and a midsole 20. The upper 10 can be made from numerous materials, including nylon, leather, canvas, etc. The midsole 20 is preferably formed of a foamed, resilient material, such as polyurethene ("PU"), ethylene vinyl acetate ("EVA"), or other suitable materials. The midsole 20 has an opening 22 formed in a rear surface thereof. Immediately adjacent to the opening 22 are formed finger grooves 24 for use in clasping a light assembly 30, that is slidably insertable into and removable from the midsole 20.

The light assembly 30 comprises a cartridge 303 that is insertable into a receptacle 308 disposed in the midsole 20. The cartridge 303 has formed thereon protrusions 32, 34 that mate with the finger grooves 24 formed in the midsole 20 when the cartridge 303 is fully inserted into the midsole 20. The cartridge 303 includes a light hole, or aperture, 301 from which visible light is radiated when the lighting system is illuminated. A release mechanism 302 is provided immediately adjacent to the protrusion 34, and is operated by the wearer's fingers when clasping protrusions 32, 34 on the light assembly 30.

The cartridge 303 includes a snap-on cover 305 and a finger well 304 into which the wearer inserts a finger in order to remove the cover 305. A mechanically operated pressure switch 306 extends through the cover 305 and is operated by pressure from the foot of the wearer while standing, walking or running. Switch 306 may be formed in a rounded fashion or with a slanted leading edge, shown by the dotted lines in FIG. 5, to enable the switch to engage, and be easily slidable into, the opening 22. The cover 305 is provided with a pair of cover tabs 307 that are secured via a friction fit in chamfered slots 314 formed in the cartridge body to hold cover 305 in place.

Receptacle 308, disposed in a cavity 26 in the midsole 20, includes a slot 309 that allows the switch 306 to pass therethrough. Slot 309 includes a rounded portion 310 that is shaped to accommodate the switch 306, and defines a forward position of the switch relative to receptacle 308.

Lighting assembly 30 includes a light emitting diode (LED) 311 as the source of visible light. It should be understood that other light sources, such as an incandescent neon, halogen, etc., bulbs, may be utilized in place of the LED 311. However, LEDs have been found to deliver sufficient light while consuming small quantities of battery power, thus extending the battery life. As such, LEDs are the preferred light source. Extending from the LED 311 are first and second leads 316 and 317. The second lead 317 is provided with an insulated cover 318 along a portion of its length that passes adjacent to a bottom surface of battery 315 disposed in cartridge 303. The battery 315 is preferably a 3-volt, dry cell, lithium, "button-type" battery, such as that found in watches, toys, and the like. This type of battery typically includes two terminals, a positive and negative terminal, with the top of the battery forming the positive terminal, and the bottom forming the negative terminal. However, any suitable, small source of electrical power may be utilized with the present invention.

The first and second leads 316, 317 pass through a lead channel 319 that extends from the light aperture 301 along a lower planar surface of a battery well 324 that is formed in the cartridge 303 and sized to accommodate the battery 315. A switch well 328 is also formed in the cartridge 303 to receive components of the switching mechanism 306. A wall 333 is formed between battery well 324 and the switch well 328. A channel 334 is formed in an upper surface of the wall 333 to accommodate a hooked portion 335 of the second lead 317 of the LED 311. The upper surface of the cartridge 303 is provided with a relieved portion 336, which defines a cover support surface 325 shaped to accommodate the cartridge cover 305 thereon. Although the cover 305 may be adhered to cartridge 303 through the use of an adhesive or other suitable bonding agent, in the preferred embodiment, relieved portion 336 is sized to provide a friction fit between the cover 305 and cartridge 303.

Attached to the cover 305 is a battery lead 320, which may be adhered to the cover 305 through the use of an adhesive agent, or may be mechanically affixed thereto through the use of a rivet, screw or other suitable device. The battery lead 320 contacts an upper surface of the battery 315 when cover 305 is disposed on cartridge 303. The lead 320 also contacts a conductive surface 321 disposed on the cover support surface 325. The switch 306 includes a base plate portion 322 having an electrically conducting contact plate 323 disposed in a well 332 formed therein. The battery lead 320 is formed to extend from the battery 315, to the conductive surface 321, and thence, to the contact plate 323 on base plate 322.

The switching mechanism disposed in the switch well 328 includes a spring 340 having a plurality of legs 330 and an upper support plate 331. The spring 340, which is preferably formed of beryllium-copper, spring steel or other suitably resilient material, is capable of providing sufficient spring force to upwardly bias the switch 306 over the life of the shoe 1. When the spring 340 is disposed in switch well 328, the upper support plate 331 supports switch 306 via the base plate 322.

When the battery 315 is disposed in the battery well 324, first and second leads 316, 317 from the LED 311 extend through the lead channel 319 defined by sidewall portions 329 underneath the battery 315. The first lead 316 is formed so as to contact a lower surface of the battery 315. The second lead 317 avoids contact with the lower surface of the battery 315 through the agency of the insulated cover 318. A hook-shaped portion 335 is provided at a distal end of lead 317, which allows lead 317 to extend over wall 333 through channel 334 and make physical contact with contact plate 323.

Release mechanism 302 is integrally formed with a locking arm 327, which, in turn, is integrally formed with cartridge 303. Locking arm 327 is resiliently biased so as to form a spring-like member that is aligned with the sidewalls of cartridge 303. A camming locking tab 312 is disposed on the locking arm 327 and is shaped such that the locking arm 327 is pushed away from a sidewall of receptacle 308 when the cartridge 303 is inserted therein. The resilient nature of the locking arm 327 causes the locking tab 312 to be biased towards the side wall of receptacle 308. A slot 313 is formed in the side wall of the receptacle 308 to receive the locking tab 312 in an over-center, locking engagement when the lighting assembly 30 is fully inserted in the receptacle 308. In this fashion, the locking tab securely holds the lighting assembly 30 in the receptacle 308.

Figure 3:
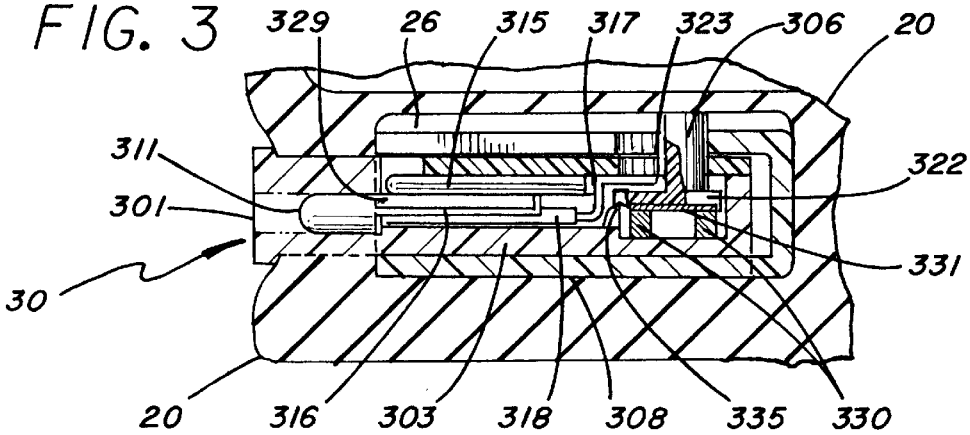
FIG. 3 is a cutaway side view taken along the lines 3—3 of FIG. 2.
Figure 5:
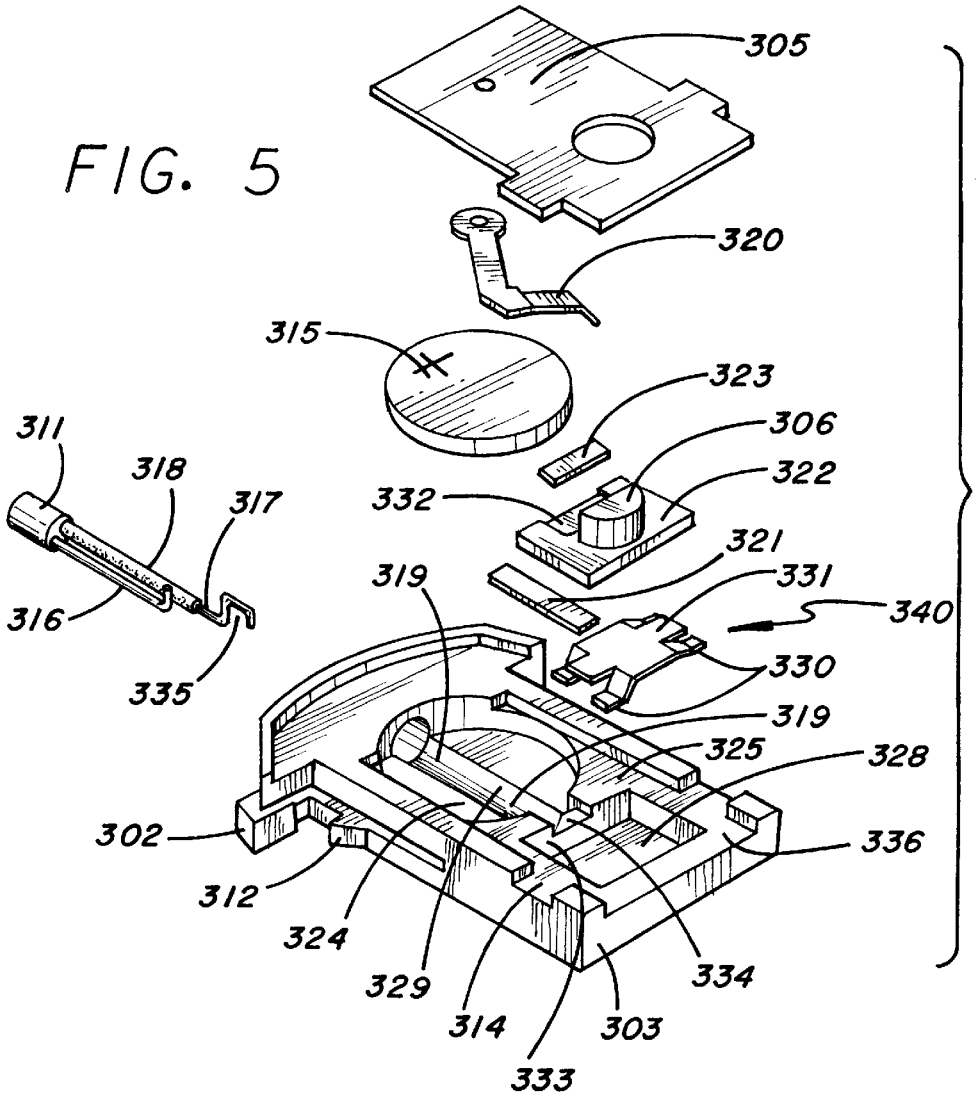
FIG. 5 is an exploded view showing the components of the lighting assembly of the present invention.
Figure 4:
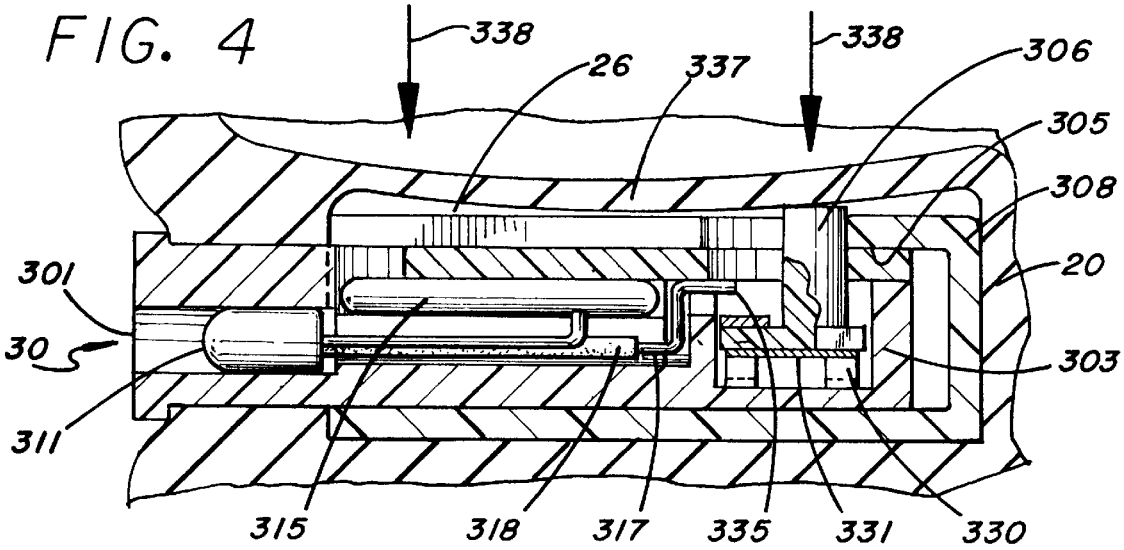
FIG. 4 is a cutaway side view taken along the lines 3—3 of FIG. 2 showing pressure being applied to the lighting system.

In operation, the lighting assembly shown in FIGS. 1–5 functions as follows. A wearer of athletic shoe 1 inserts the lighting assembly 30 into the opening 22 formed in the midsole 20. Referring in particular to FIGS. 3–4, it is seen that the cavity 26 is formed in the midsole 20 and provides a space above the receptacle 308 to accommodate the extension of the switch 306 therein. Switch 306 is normally biased, through the agency of the spring 340, against a portion of the midsole 20 beneath the heel of the wearer.

As seen in detail in FIG. 4, when the wearer of the athletic shoe 1 applies pressure in a downward fashion, such as when standing, walking or running, midsole 20 deforms and protrudes into cavity 26, forcing switch 306 to be biased in a downward fashion. Legs 330 of spring 340 deform to accommodate the pressure applied by the wearer. Contact plate 323 breaks physical contact with the hook-shaped portion 335 of lead 317 in response to the downward pressure from the wearer. This, in turn, creates an electrical break between the second lead 317 and the battery lead 320, which are electrically connected through the contact plate 323. As a result, power is not supplied from the battery 315 to the second LED lead 317 while pressure is being applied on the switch by the wearer.

The thickness of the resilient midsole portion 20 below the wearer's heel may be adjusted to act as a switch moderator. In addition, the material comprising the midsole portion below the wearer's heel can be replaced with an insert of a material that is different from the remainder of the midsole, yet be suitably resilient to flex when pressure is applied by the foot of the wearer. By altering the thickness and/or durometer thereof, the force applied to the switch from the wearer's foot can be adjusted such that the minimum downward pressure on the midsole necessary to extinguish the light can be changed accordingly. In this fashion, the thickness and/or durometer of the insert can be adjusted to accommodate the particular needs of different types of wearers, e.g., male vs. female, adult vs. child, etc.

Thus, as shown in FIG. 4, when the wearer of the athletic shoe 1 is in a standing position and applying pressure to the upper portion of the midsole 20, the switch 306 is biased in a downward fashion, and power is therefore disconnected from the LEDs 311. When the shoe 1 is raised from the ground, thereby removing pressure from the midsole 20, the upper surface of the midsole returns to its normal position, thereby allowing the switch 306 to be biased upwardly by the spring 340. When switch 340 is biased upward, the contact plate 323 makes physical contact with the hook-shaped portion 335 of the second lead 317, and this completes an electrical connection between the second LED lead 317 and the battery lead 320.

Since the first LED lead 316 is in constant contact with a lower surface of battery 315, when plate 323 contacts lead 317, power is supplied from the battery 315 to the LED 311, thus causing the LED to illuminate. Visible light is thus emitted through the light aperture 301 formed in the cartridge 303. In this fashion, when the wearer of the athletic shoe 1 applies pressure in a downward fashion, LED 311 is prevented from emitting visible light. When the shoe is lifted from the ground, LED 311 illuminates and visible light is emitted via light aperture 301.

To disable the lighting assembly, the wearer grasps the protrusions 32, 34 formed in the cartridge 303, thereby activating the release mechanism 302. The activation of the release mechanism 302 causes the locking arm 327 to be displaced in a lateral fashion into slot 326 formed between the locking arm 327 and the main body of cartridge 303. Slot 326 is sized so as to accommodate the size of the locking tab 312 such that, when the release mechanism 312 is fully pressed, the locking tab 312 may slidably bypass slot 313 without engaging it. This enables the wearer to slidably remove the cartridge 303 from the receptacle 308.

Once cartridge 303 is removed, cover 305 can be removed and the battery 315 can be withdrawn from the cartridge 303 for replacement. In the preferred embodiment, to disable the lighting system, the wearer simply removes the cartridge 303 from the shoe, inverts it after removal, and then re-inserts it into the opening 22. The locking tab 312 engages a corresponding slot 313' formed on a wall of the receptacle 308 in opposing relation to the slot 313. The base of receptacle 308 causes the switch to be continually biased into the cartridge 303, thereby deactivating the lighting system and preventing its operation for as long as the cartridge is inserted in the inverted position.

Alternatively, the wearer can remove the battery from the cartridge, invert the battery, and re-insert it into the cartridge. This causes a back-biasing of the LED 311, which is sensitive to battery polarity, and prevents the LED from illuminating. As a further alternative, the wearer may simply remove the cover 305, remove the battery 315 from the cartridge 303, replace the cover 305, and re-insert the cartridge 303 into receptacle 308. In this fashion, the wearer may effectively disable the lighting assembly 30, if it is so desired.

The lighting assembly 30, including receptacle 308, may be formed of a thermoplastic, polycarbonate, fiberglass resin, or other suitable, lightweight material that provides sufficient structural integrity to support the weight of the wearer during all normal activities, such as walking and running. The structural integrity of the lighting assembly 30 is not harmed due to the removal or inversion of the battery or other components of the lighting assembly 30.

Turning to FIGS. 6–9, a second embodiment of the lighting system of the present invention is disclosed. The second embodiment is directed to a "drop-in" module 40 that can be plugged into a cavity 26 formed in an upper surface 21 of the midsole 20 in a vertical direction.

A cover 27, which may be formed of the same material as the midsole 20, is provided to cover the module 40 when it is positioned in cavity 26. Passages 28 are formed in the midsole adjacent to the cavity 26, to allow light to pass from the drop-in module 40 to a translucent structure 29 disposed in a slot 25 formed in the rear portion of the midsole 20. The slot 25 extends about the circumferential, rear-side surface of the midsole 20, thereby enabling light emitted from module 40 to be dispersed about the circumference of the heel of the shoe 1. The translucent structure 29 is formed so as to provide structural integrity about the heel portion of the shoe 1 to support the wearer of the shoe.

Drop-in module 40 includes a plurality of LEDs 411 disposed on the module body 403. A pressure switch 406 similar to that described in connection with the first embodiment extends through an upper cover 405 of the module 40. The cover 405 is formed in a fashion similar to the cover 305 discussed above. The cover 405 may be removed to enable access to the battery 415 for replacement, or to disable the lighting system in the manner discussed in more detail below.

Each of the LEDs 411 have a pair of leads extending therefrom. Two of the LEDs 411 have a first lead 412, which are fused together by welding or other suitable process, and are then positioned so as to contact a lower surface of a battery 415 when it is disposed in the module body 403. Another of the LEDs 411 includes a first lead 413 that is also formed to contact the lower surface of the battery 415.

The LEDs 411 each include a second lead that are fused together at a point 414 through welding, soldering, crimping, or another suitable process. A single lead 417 extends from the junction point 414 of the second leads. The single lead 417 is formed similar to the second lead 317 discussed with respect to the first embodiment to include a hook-shaped structure 435 identical to the hook structure 335 discussed above.

The battery lead 420, which is joined with or attached to cover 405 in a manner similar to the first embodiment, contacts an upper surface of battery 415 and connects with a conductive surface 421, and with a contact plate 423, in the same manner as the battery lead 320 of the first preferred embodiment. The internal structure of the module 403 is substantially similar to the cartridge 303 discussed above, with the exception of channels 419, which are formed in a cross-shaped pattern in order to accommodate the multiple leads from the plurality of LEDs 411.

Figure 9:
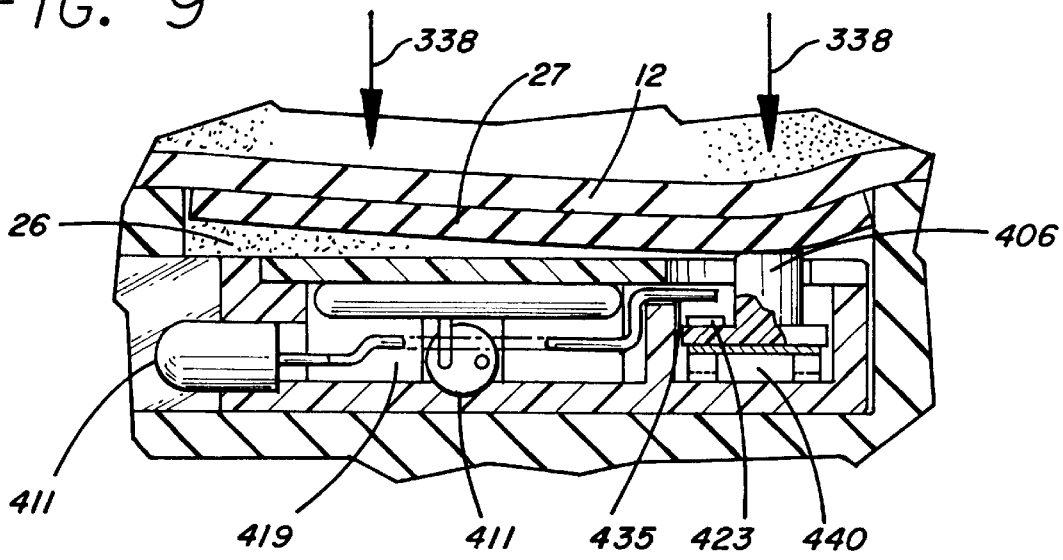
FIG. 9 is a cutaway side view taken along the lines 8—8 of FIG. 7 showing pressure being applied to the second embodiment of the lighting system shown in FIG. 7.
Figure 7:
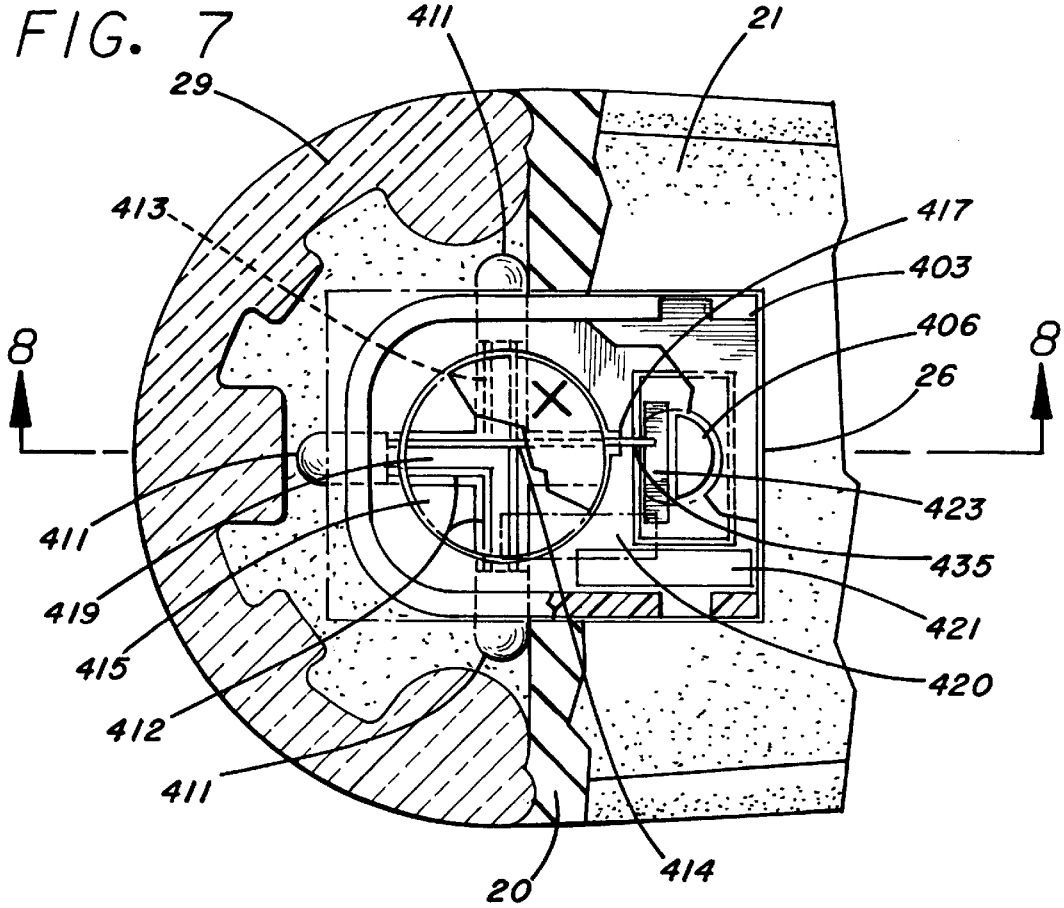
FIG. 7 is a cutaway top view of the lighting system of FIG. 6 shown disposed in a midsole of an athletic shoe.
Figure 8:
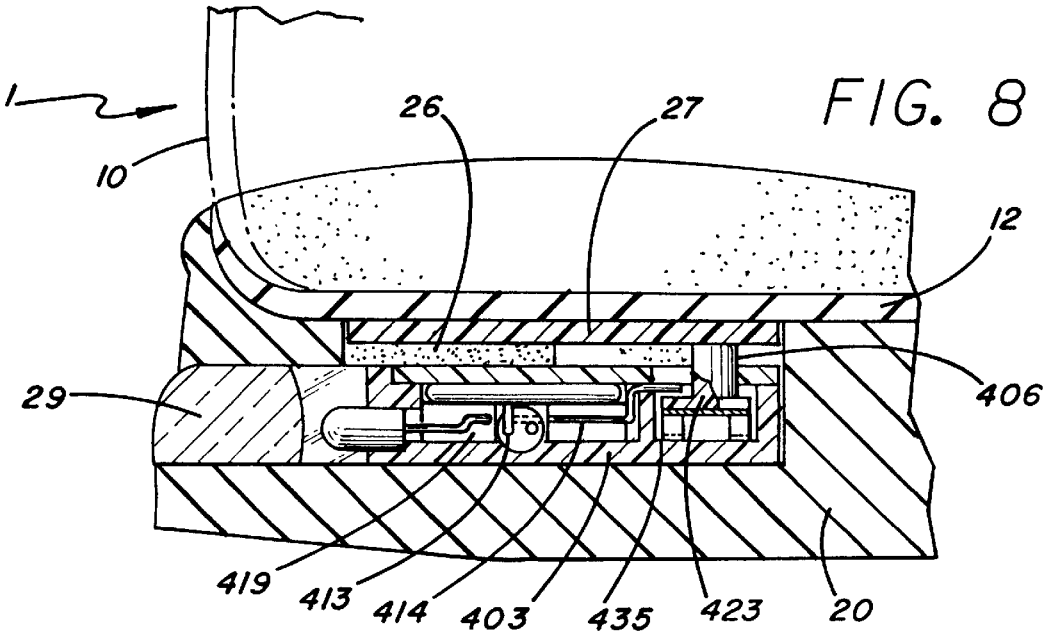
FIG. 8 is a cutaway side view taken along the lines 8—8 of FIG. 7.
Figure 10:
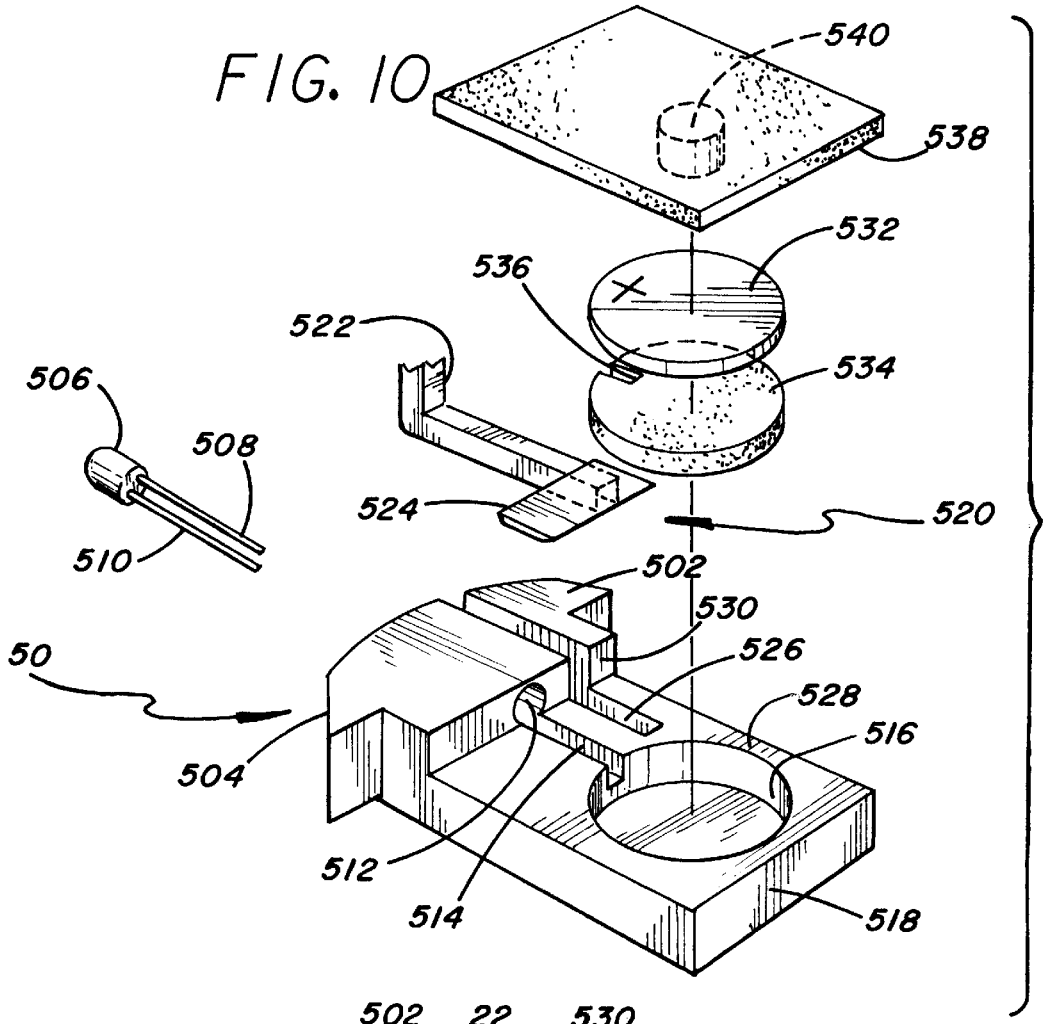
FIG. 10 is an exploded view of a third embodiment of a lighting system in accordance with the present invention.
Figure 11:
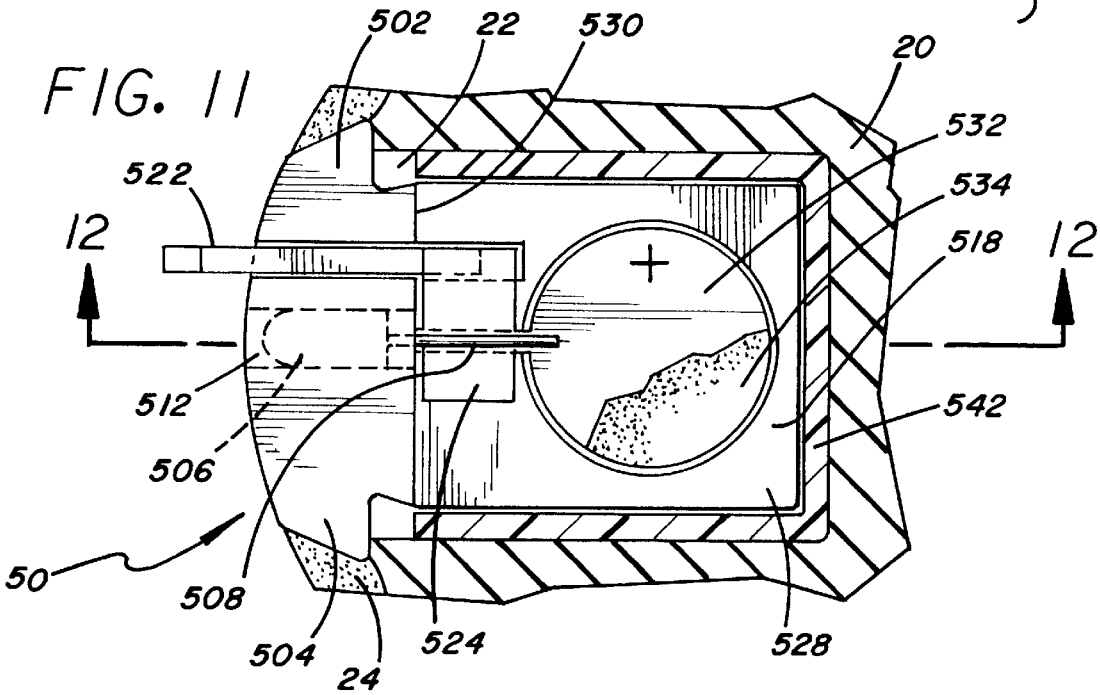
FIG. 11 is a cutaway top view of the lighting system shown in FIG. 10 disposed in a shoe.
Figure 12:
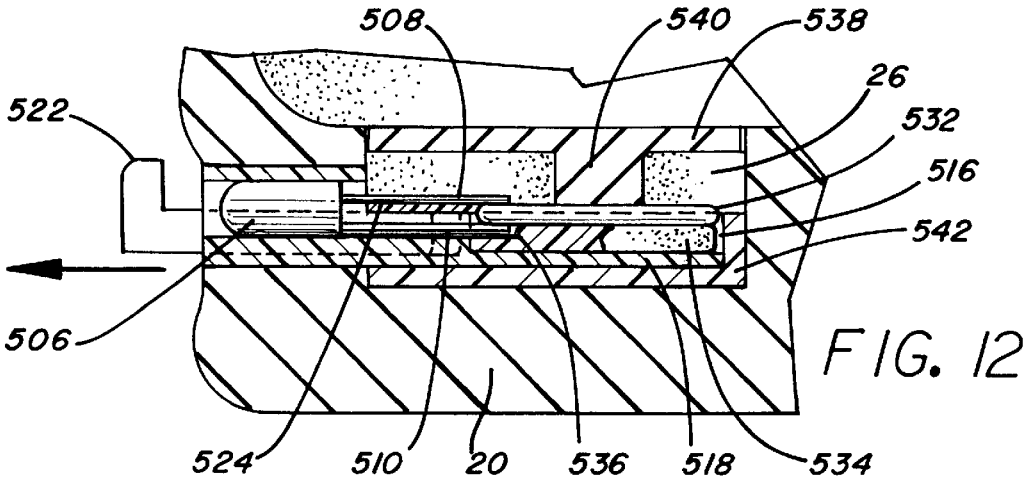
FIG. 12 is a cutaway side view taken along the lines 12—12 of FIG. 11.
Figure 13:
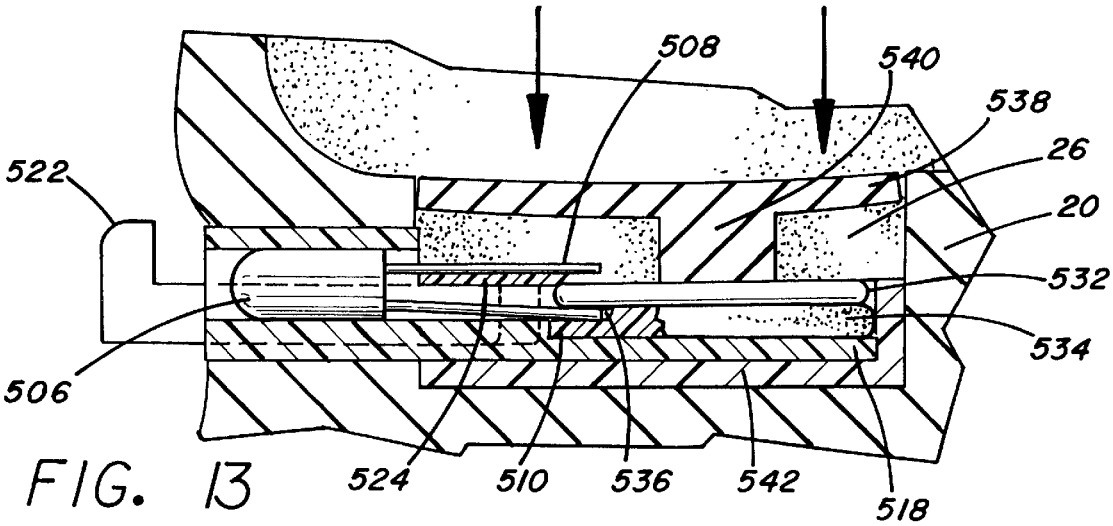
FIG. 13 is a cutaway side view taken along the lines 12—12 of FIG. 11 showing pressure being applied to the lighting system of FIG. 10.

The operation of the second embodiment is best illustrated in FIGS. 8 and 9. In this embodiment, the athletic shoe 1 is shown fitted with an insole 12, which is disposed above a cover 27 that covers the drop-in module 40. As with the first embodiment, when pressure is applied in a downward fashion on the midsole 20, the switch 406 is biased in a downward fashion causing an electrical break between the hook-shaped LED lead 435 and the contact plate 423. The downward biasing of the switch 406 prevents electrical power from being supplied from the battery 415 to the LEDs 411, thereby preventing the LEDs 411 from illuminating.

The cover 27, which is made of a resilient material, can act as a switch moderator to moderate the pressure applied to the switch 406 by altering the thickness and/or the durometer of the cover or the material from which the cover is made.

When pressure is removed from the midsole 20, the spring 440 biases the switch 406 in an upward fashion, causing an electrical contact to be made between the hook-shaped LED lead 435 and the contact plate 423. This causes power to be supplied from the battery to the hook-shaped LED lead 435. Since each of the LEDs 411 is already in contact with a lower surface of the battery 415, this completes the electrical connection between the battery 415 and the LEDs 411, thereby enabling the LEDs 411 to illuminate. The visible light is conveyed from the LEDs 411 through the light passages 28 formed in the midsole 20. The transparent or translucent structure 29 receives and passes the visible light to the exterior of the shoe 1.

The lighting system of the second embodiment can also be disabled by the wearer in a manner similar to that of the first embodiment. First, the wearer removes the insole 12 and cover 27. The module 40 is then removed from the cavity 26, inverted, and re-inserted into the cavity. The cover 27 and insole 12 are then replaced. In this fashion, switch 406 is continously biased into the module 40 due to the action of the base of cavity 26 on the switch 406, thereby deactivating the lighting system, while still permitting the shoe to be worn in a conventional manner.

Alternatively, the cover 405 can be raised to enable access to the battery 415. Battery 415 can then be removed or inverted, after which the module 40 is reinserted into the cavity 26. Inverting the battery back-biases the LEDs 411 in the same manner as with the first embodiment. By re-inserting the module 40 into cavity 26, shoe 1 is provided with structural integrity, even when the lighting system of the present invention has been disabled.

A third preferred embodiment of the present invention is illustrated in FIGS. 10–14.

Figure 6:
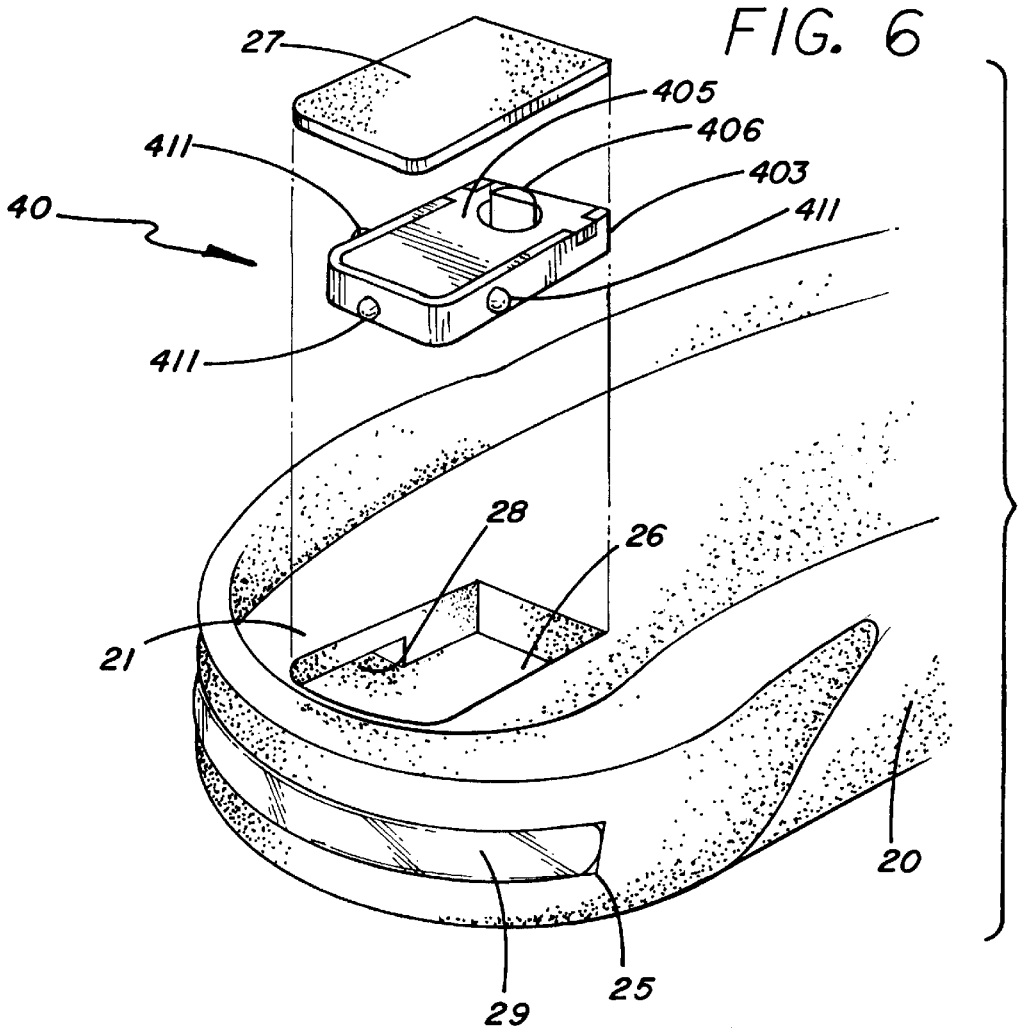
FIG. 6 is an exploded perspective view of a second embodiment of the lighting system of the present invention.

A light cartridge 50 is plug-in insertable into and removable from a cavity 26 formed in the midsole 20 of an athletic shoe 1, such as that shown in FIGS. 1 and 6. In this embodiment, which may also be implemented as a drop-in module, as described above, a cartridge 50 includes a pair of flanged edges 502, 504, which are utilized, in a fashion similar to the protrusions 32, 34 formed on the light assembly 30 shown in FIG. 1, to grasp cartridge 50 during insertion/removal of the cartridge from the cavity 26. Such flanged edges are unnecessary for a drop-in embodiment.

A receptacle 542 is disposed in the midsole 20 to receive the cartridge 50. An LED 506 is disposed in the cartridge 50 in a cavity 512 formed therein. The LED 506 has first and second leads, 508, 510 that extend through the cavity 512 via a groove 514 formed in a casing 518 of the cartridge 50. A battery well 516 for retaining a battery 532 is also formed in the cartridge casing 518.

An enabling/disabling mechanism 520 is provided with the light cartridge 50. The mechanism 520 allows the wearer to enable and disable the lighting system of this embodiment. The enabling/disabling mechanism 520 includes a lever arm 522 and an LED lead insulator 524. A slot 526 is formed in the cartridge casing 518 to slidably receive the lever arm 522. When the lever arm 522 is disposed in the slot 526, the lead insulator 524 is disposed flush against an upper planar surface 528 of the cartridge casing 518.

A rear wall structure 530 extends upward from the upper planar surface 528 and forms a rear stopping mechanism to limit the rearward movement of the lead insulator 524. Lever arm 522 and lead insulator 524 may be integrally formed or may be formed separately and bonded together using an adhesive or other suitable bonding agent. The lever arm 522 and lead insulator 524 may be formed of plastic or other electrically insulating material. The cartridge 50 may be formed of the same materials as the cartridge and module of the first and second embodiments.

The battery 532 is supported in battery well 516 via a battery support 534 that may be made of the same resiliently flexible material as the midsole 20. The battery support 534 is provided with a groove 536 formed therein that receives a portion of the second LED 510. A cover 538, which may be formed from the same material as the midsole 20, is provided to cover the cartridge 50 after it is inserted into the midsole 20. Cover 538, which can also serve as a switch moderator in the manner discussed above with respect to cover 27 and the moderator of the first embodiment, is provided with a battery pressing member 540, which rests on the battery 532. The battery pressing member 540 may be formed integrally with the cover 538 as shown in the drawings, or may be made from a different material and affixed to the cover 538.

In operation, when a downward pressure is applied on cover 538, such as when a wearer of the shoe 1 stands, walks, or runs, the pressing member 540 exerts a downward force on the battery 532. This causes the battery support 534 to be compressed, which, in turn, causes the second LED lead 510 to bend downward, resulting in the creation of a spaced relationship between an upper surface of the battery 532 and the first LED lead 508. This configuration can best be seen in FIG. 13.

When pressure is removed from the cover 538, the resilient battery support 534 decompresses, biasing the battery 532 and the second LED lead 510 in an upward fashion. Due to the provision of the groove 536 formed in the battery support 534, the second LED lead 510 remains in contact with the bottom surface of the battery 532. The battery 532 then contacts the first LED lead 508, allowing power to be supplied to the LED 506. Thus, visible light is emitted from the cartridge 50. When pressure is again applied to the cover 538, the physical contact between the first LED lead 508 and the battery 532 is broken, thereby removing electrical power from the LED 506 and preventing illumination of LED 506.

The enabling/disabling mechanism 520 allows the wearer to control the operation of the light cartridge 50 without the necessity of removing the cartridge from the shoe, i.e. while the shoe is being worn. If the user wishes to enable the operation of light cartridge 50, the lever arm 522 is drawn in a rearward fashion relative to the shoe 1, which causes the lead insulator 524 to be drawn away from the battery 532 and be positioned adjacent to the wall structure 530. This allows the battery 532 to make contact with the first LED lead 508 and supply power to the LED 506.

Figure 14:
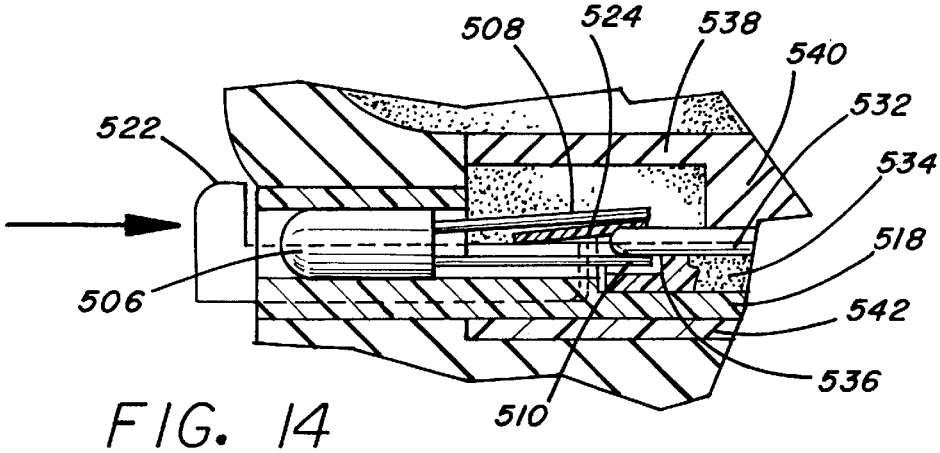
FIG. 14 is a cutaway side view of the lighting system of FIG. 10 showing the operation of a disabling mechanism.

To disable the light cartridge 50, the wearer pushes the lever arm 522 into the shoe 1. This causes the lead insulator 524 to be positioned between the battery 532 and the first LED lead 508 as shown in FIG. 14. It should be noted that lead insulator 524 is formed with an angled-forward edge to assist in allowing the lead insulator 524 to be slidably positioned between the battery 532 and the first LED lead 508. When the lever arm 522 is moved to the forward most position, lead insulator 524 will prevent physical contact from occurring between the battery 532 and the first LED lead 508, regardless of the presence or absence of pressure being exerted on the midsole of the shoe 1. This prevents power from being supplied to LED 506 and disables the light cartridge 50.

If the user wishes to permanently disable light cartridge 50, the cartridge 50 may be removed from the shoe 1 and the battery removed therefrom. To accomplish this, the wearer grasps the flanged edges 502, 504 of the cartridge 50 and withdraws it from the receptacle 542. Alternatively, the wearer could remove the insole (not shown) from the shoe 1 and remove the cover 538 from the drop-in cavity 26 in which the cartridge 50 is disposed. In this fashion, the wearer is able to access the battery 532 and disable the light cartridge 50.

The above-discussed three exemplary preferred embodiments merely illustrate the currently-preferred embodiments for carrying out the present invention. One skilled in the art will readily understand that numerous modifications and/or additions could be made to the above-discussed embodiments without departing from the spirit and scope thereof.

For example, those skilled in the art will recognize that it is a simple modification to replace one or more of the conventional LEDs described above with LEDs containing an integral flasher chip, such as those sold by the Tandy Corporation under part number 276-036C. This substitution will result in footwear that flashes on and off so long as the wearer's foot is off the ground. A similar result can be achieved by inserting a solid state oscillator circuit chip, such as that found in the Vitelic Corporation part number VH-215 between the battery and the conventional LEDs in the electrical circuit of the system.

Also, it should be noted that the materials used to form the lighting assemblies of the present invention are limited solely by the resources available to one skilled in the art, and the constraint that the lighting assembly is required to have sufficient structural integrity in order to support a wearer. Thus, while the above-discussed preferred embodiments contemplate the use of plastic or other similar material to form the lighting assemblies, other materials may be utilized such as metal, ceramics, etc.

In addition, while the light emitting diode is the preferred illumination mechanism in accordance with the present invention, it is to be understood that other light emitting devices could be substituted for the light emitting diode. For example, incandescent lighting mechanisms, halogen, neon, etc., lighting systems could be utilized with the present invention. Although the preferred embodiment contemplates light being emitted in the vicinity of the heel portion of the shoe 1, it is to be understood that electrical conductors could be utilized to position light emitting devices about the periphery of the shoe without departing from the spirit and scope of this invention.

Thus, it is intended that the embodiments discussed above be viewed as illustrative in nature, and that the present invention be solely limited by the claims appended below.

What is claimed is:

1. Footwear for improving visibility of a wearer thereof, said footwear including an upper portion for contacting an upper surface of a wearer's foot and a sole portion for underlying a lower surface of the wearer's foot and supporting the wearer's foot against the ground, the improvement comprising:

a cavity formed in said sole portion, said cavity having an upper surface and a lower surface;

a plug-in module, slidably insertable into and removable from said cavity, said plug-in module including:

a light source disposed in said plug-in module such that light emitted from said light source is visible exteriorly of said plug-in module;

a power source for energizing said light source; and, switch means, operatively responsive to close when the wearer's foot is removed from the ground, for selectively connecting said power source to said light source to cause illumination of said light source, said switch means being operatively responsive to open when the wearer's foot is applied to the ground, thereby extinguishing the illumination of said light.

2. The footwear of claim 1, wherein said switch means includes means, responsive to pressure from a wearer's weight applied to the ground through said sole portion, for opening said switch means, and for closing said switch means when pressure from the wearer's weight is removed from the ground.

3. The footwear of claim 2, wherein said switch means includes:

a pressure-receiving member disposed in said plug-in module so as to be positioned adjacent to said upper surface of said cavity when said plug-in module is inserted in said cavity;

a base plate having upper and lower base plate surfaces, said base plate supporting said pressure receiving member on said upper base plate surface;

an electrical contact plate disposed on said upper base plate surface; and a spring member, disposed in said plug-in module, for supplying an upward biasing force against said lower base plate surface so as to bias said pressure receiving member upward relative to a lower surface of said cavity.

4. The footwear of claim 3, wherein said light source comprises a light emitting diode having first and second electrical leads extending therefrom, said power source comprises a battery having first and second terminals, said first electrical lead of said light emitting diode contacts said first terminal of said battery, and said second electrical lead selectively contacts said electrical contact plate.

5. The footwear of claim 4, further including means for connecting said second terminal of said battery with said electrical contact plate, wherein said pressure-receiving member is operatively responsive to pressure from the foot of the wearer to bias said base plate downward relative to said lower surface of said cavity, thereby preventing contact between said second electrical lead and said electrical contact plate, said spring member being operatively responsive to an absence of pressure from the foot of the wearer to bias said base plate upward relative to said lower surface of said cavity, thereby causing contact between said second electrical lead and said electrical contact plate.

6. The footwear of claim 1, wherein said switch means includes:

an on-off switch that is in a normally closed condition, said switch having an actuator for opening said switch in response to a force exerted on said actuator and being disposed in said plug-in module with said actuator in facing communication with the lower surface of the wearer's foot when said plug-in module is disposed in said cavity such that, when the wearer's weight is applied to the ground through said sole portion, the lower surface of the wearer's foot exerts a downward force on said actuator, thereby opening said switch, and when the wearer's weight is removed from the ground through said sole portion, the force exerted on said actuator is removed, thereby returning said switch to said normally closed condition.

7. The footwear of claim 6, further comprising:

switch moderator means for controlling the amount of force applied to said actuator by the wearer's foot, said switch moderator means including a thickness of resilient material disposed between said switch actuator and the lower surface of the wearer's foot.

8. The footwear of claim 1, wherein said light source comprises a light emitting diode.

9. The footwear of claim 1, further comprising:

a receptacle, disposed in said sole portion for slidably receiving said plug-in module; and locking means for releasably securing said plug-in module in said receptacle.

10. The footwear of claim 9, wherein said locking means comprises:

a slot formed in a surface of said receptacle;

a protrusion, extending from a surface of said plug-in module and resiliently biased against said surface of said receptacle so as to be lockably engaged in said slot when said plug-in module is inserted into said receptacle, thereby securing said plug-in module in said receptacle; and releasing means, for releasing said protrusion from engagement with said slot to enable said plug-in module to be removed from said receptacle.

11. The footwear of claim 10, wherein said releasing means comprises a lever arm having said protrusion disposed thereon, said lever arm being integrally formed with said plug-in module and resiliently biased against said surface of said receptacle when said plug-in module is inserted therein, said lever arm being movable relative to said slot such that said protrusion can be moved out of engagement with said slot to enable said plug-in module to be removed from said receptacle.

12. Footwear with means for increasing visibility of a wearer thereof, comprising:

an upper section formed of a flexible material for enclosing an upper portion of a wearer's foot;

a sole portion for underlying a lower surface of the wearer's foot and supporting the wearer's foot against the ground, said sole portion being attached to said upper section and having an upper surface defining a footbed for supporting the lower surface of the wearer's foot, and an outsole surface for contacting the ground;

a removable light mechanism, insertable into and removable from a cavity formed in said sole portion, said light mechanism including:

an electric light source mounted in said removable light mechanism such that light emitted from said source is visible exteriorly of said footwear;

a battery, selectably connectable to said light source, for energizing said light source;

switch means for selectively connecting and disconnecting said light source to and from said battery, said switch means being in a normally closed state such that said light source is connected to said battery in the absence of pressure on said switch means; and disabling means, operable by the wearer, for disabling said light mechanism such that said switch means is prevented from connecting and disconnecting said light source to and from said battery.

13. The footwear of claim 12, wherein said switch means includes means, operatively responsive to pressure of a predetermined level, for changing said switch means from said normally closed state to an open state, and for returning said switch means to the closed state when said pressure is reduced below said predetermined level.

14. The footwear of claim 12, wherein said disabling means comprises:

means, operable by the wearer, for interrupting the connection of said battery and said light source independently of the state of said switch means.

* * * * *